US009663312B1

(12) United States Patent
McFarland et al.

(10) Patent No.: US 9,663,312 B1
(45) **Date of Patent: *May 30, 2017**

(54) REMOVABLE MEDIA TRAY HAVING A MEDIA RESTRAINT WITH A LATCHING PLUNGER OPERABLE WITHOUT THE USE OF PINCHING

(71) Applicant: LEXMARK INTERNATIONAL, INC., Lexington, KY (US)

(72) Inventors: Neal Douglas McFarland, Versailles, KY (US); Dustin Daniel Fichter, Versailles, KY (US); Stacey Vaughan Mitchell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/060,860

(22) Filed: Mar. 4, 2016

(51) Int. Cl.
*B65H 1/04* (2006.01)
*B65H 1/26* (2006.01)

(52) U.S. Cl.
CPC ..... *B65H 1/266* (2013.01); *B65H 1/04* (2013.01); *B65H 2403/411* (2013.01); *B65H 2403/47* (2013.01); *B65H 2405/10* (2013.01); *B65H 2405/1122* (2013.01); *B65H 2405/11425* (2013.01); *B65H 2405/121* (2013.01); *B65H 2511/11* (2013.01); *B65H 2801/12* (2013.01)

(58) Field of Classification Search
CPC ..... B65H 1/266; B65H 2405/1122; B65H 2405/11425; B65H 2403/411; B65H 2511/12; B65H 2405/1142; B65H 1/04; B65H 2403/47; B65H 2405/121; B65H 2511/11
See application file for complete search history.

(56) References Cited

U.S. PATENT DOCUMENTS

| | | | | |
|---|---|---|---|---|
| 7,922,171 | B2 * | 4/2011 | Kawamura | B65H 1/26 271/145 |
| 8,066,277 | B2 * | 11/2011 | Ubayashi | B65H 1/04 271/171 |
| 8,286,962 | B2 * | 10/2012 | Tanaka | B65H 1/266 271/171 |
| 8,622,383 | B2 * | 1/2014 | Lee | B65H 1/266 271/171 |
| 9,199,808 | B2 * | 12/2015 | Shiokawa | B65H 1/266 |
| 9,278,819 | B2 * | 3/2016 | Doshida | B65H 1/04 |
| 9,290,339 | B2 * | 3/2016 | Fukunaga | B65H 1/04 |
| 9,329,551 | B2 * | 5/2016 | Yuasa | G03G 15/6502 |

(Continued)

*Primary Examiner* — Jeremy R Severson
(74) *Attorney, Agent, or Firm* — John Victor Pezdek

(57) ABSTRACT

A media restraint for a removable media tray and slidably operable without the use of a pinching force. The media restraint slidably positionable on a track in a removable media tray and is operable without pinching. A latching plunger in the media restraint is biased into engagement with a track provided in the removable media tray and is moved by a rack and pinion mechanism to a released position allowing the media restraint to be moved along the track. The media restraint is operable by a finger of the user applying a downward force to the media restraint to release the plunger from the track and allowing the media restraint to be moved along the track. Upon removal of the downward force, a biasing member reengages the plunger with the track.

20 Claims, 7 Drawing Sheets

(56) References Cited

U.S. PATENT DOCUMENTS

| | | | | |
|---|---|---|---|---|
| 2009/0295068 | A1* | 12/2009 | Kubo | B65H 1/266 271/18 |
| 2010/0270735 | A1* | 10/2010 | Allwright | B65H 1/266 271/171 |
| 2011/0140352 | A1* | 6/2011 | Tanaka | B65H 1/266 271/264 |
| 2015/0001792 | A1* | 1/2015 | Kim | B65H 1/266 271/234 |

* cited by examiner

REMOVABLE MEDIA TRAY HAVING A MEDIA RESTRAINT WITH A LATCHING PLUNGER OPERABLE WITHOUT THE USE OF PINCHING

CROSS REFERENCES TO RELATED APPLICATIONS

The present disclosure is related to U.S. patent application Ser. No. 15/060,868, entitled "REMOVABLE MEDIA TRAY HAVING A MEDIA RESTRAINT WITH TRANSLATING LATCHING CAMS OPERABLE WITHOUT THE USE OF PINCHING" filed Mar. 4, 2016 and U.S. patent application Ser. No. 15/060,878, entitled "REMOVABLE MEDIA TRAY HAVING A MEDIA RESTRAINT WITH PIVOTING LATCHING CAM OPERABLE WITHOUT THE USE OF PINCHING" filed Mar. 4, 2016, each assigned to the assignee of the present disclosure.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The field relates generally to media input feed systems for an imaging device having a removable media tray with an adjustable media restraint.

Description of the Related Art

In 1998, Congress amended the Rehabilitation Act of 1973 (29 U.S.C. §794 (d)) to require Federal agencies to make their electronic and information technology accessible to people with disabilities. Section 508 of the Rehabilitation Act applies to all federal agencies when they develop, procure, maintain, or use electronic and information technology. Under Section 508, federal agencies must give disabled employees and members of the public access to information that is comparable to access available to others. These provisions apply to operable controls which are defined as components of a product that require physical contact for normal operation. Operable controls include, but are not limited to, media restraints. Operable controls are to be operable with one hand and not require tight grasping, pinching, or twisting of the wrist. Thus, under these requirements, the media restraint needs to be operable without the use of a pinching force.

Media restraints in removable media trays are typically provided along a bottom and side edge of a media area within the removable media tray for holding the media in place for feeding into an imaging device. The media restraints are moveable along tracks in the removable media tray to accommodate different media sizes. These media restraints are operated by a user pinching an actuation member or lever to release the media restraint from engagement with the track, and, while still pinching the actuation member or lever, moving the media restraints to a new position in the removable media tray.

It would be advantageous to have a media restraint that can be operated without the use of a pinching force. It would be further advantageous, that such a media restraint would also be moveable using a single finger.

SUMMARY OF THE INVENTION

Disclosed is a removable media tray having a media restraint that is operable without the use of a pinching force. The removable media tray comprises a bottom surface for holding media to be fed to the imaging device, a track having a plurality of teeth along a length of the track and positioned on the bottom surface, and, a media restraint slidably engageable with the track. The media restraint includes a bottom plate having a first opening therethrough, a front plate and a rear plate each depending from the bottom plate, and, a latching mechanism. Included in the latching mechanism are a pinion gear rotatably attached to one of the front and rear plates between a top and a bottom thereof, an actuator and a plunger slidably received between the front and rear plates, and a biasing member. The actuator has a first position adjacent to the top plate and has a button portion at an upper end thereof positioned adjacent a top of the front and rear plates and a leg portion depending from the button portion and extending toward the bottom plate. The leg portion has a rack engaged with the pinion gear. The plunger has a serrated bottom end slidably received in the first opening and a rack engaged with the pinion gear. The plunger has a corresponding first position wherein the serrated bottom end is engaged with the track when the actuator is in its first position. The biasing member biases the actuator and the plunger into their respective first positions.

Upon application of a user-supplied downwardly directed force to the button portion, the actuator moves from its first position and translates downwardly with the rack of the leg portion thereby rotating the pinion gear and raising the plunger from its first position allowing the media restraint to be translated along the track to a new location. When the downwardly directed force is removed, the biasing member returns the actuator and plunger to their respective first positions.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

FIGS. 3A, 3C show an engaged position and FIG. 3B shows an actuated or disengaged position for the media restraint.

FIG. 4A illustrates the media restraint in its first or engaged position and FIG. 4B illustrates the media restraint in an actuated or disengaged position.

FIG. 5A illustrates the media restraint in its first or engaged position and FIG. 5B illustrates the media restraint in an actuated or disengaged position.

FIG. 6A shows the media restraint in an engaged position and FIG. 6B shows the media restraint in an actuated or disengaged position.

FIG. 7A shows the media restraint in an engaged position and FIG. 7B shows the media restraint in an actuated or disengaged position.

FIG. 8A shows the media restraint in an engaged position and FIG. 8B shows the media restraint in an actuated or disengaged position.

DETAILED DESCRIPTION

Figure 1:
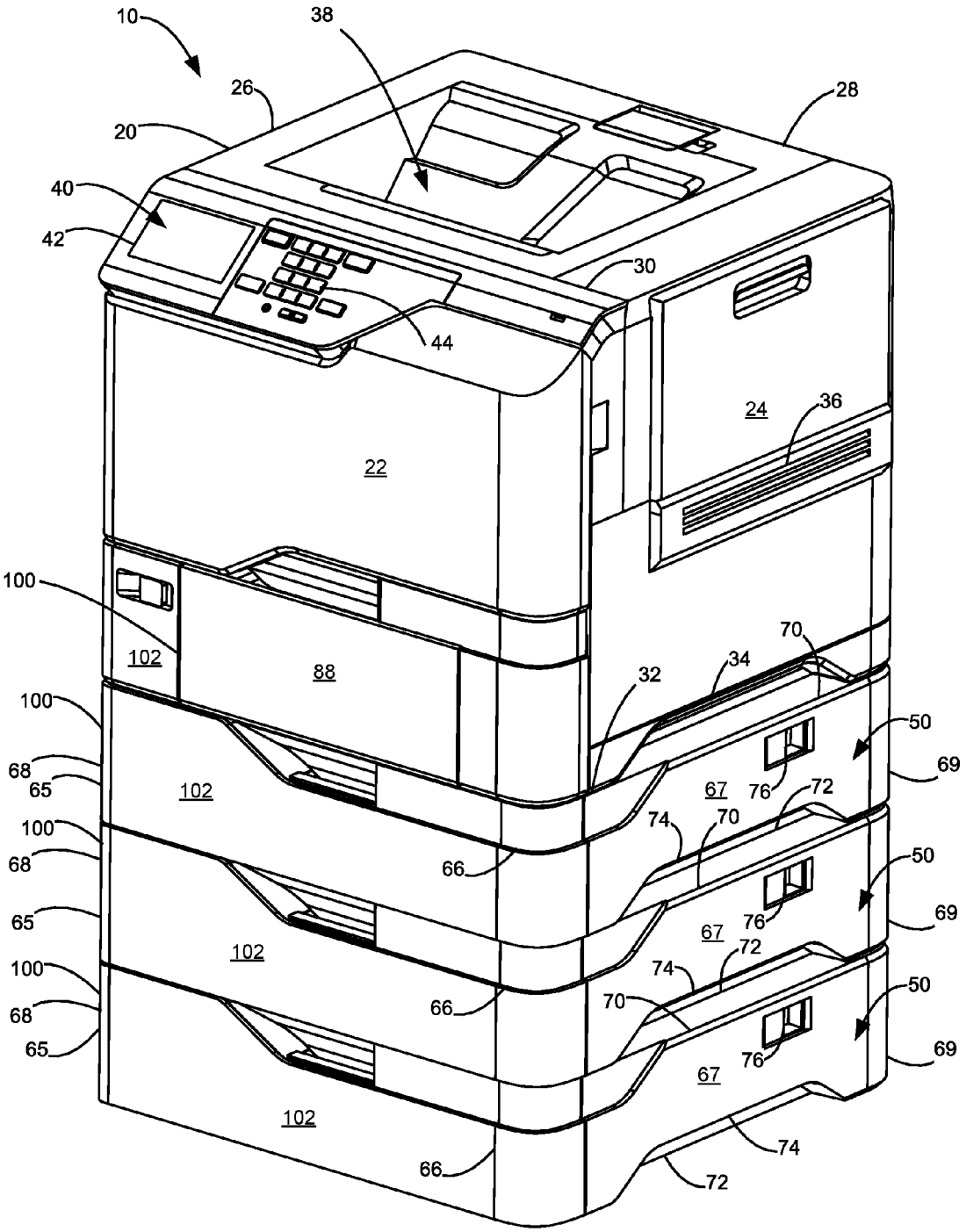
FIG. 1 is an illustration of an imaging device having a removable media tray attached to a stack of option assemblies each of which also have a removable media tray.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the media restraint of the present disclosure. Furthermore, and as described in subsequent paragraphs, the specific mechanical configurations illustrated in the drawings are intended to exemplify embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging device. The terms "spring seat" or "spring mount" are used interchangeably.

FIG. 1 illustrates an example imaging device 10 atop three example option assemblies 50. Imaging device 10 has a housing 20 having a front 22, a first and second sides 24, 26, a rear 28, a top 30 and a bottom 32 and into which a removable media tray 100 is slidably inserted. Option assembly 50 has a housing 65 having a front 66, a first and second sides 67, 68, a rear 69, a top 70 and a bottom 72 and into which removable media tray 100 is slidably inserted. A user interface 40 comprising a display 42 and a key panel 44 may be located on the front 22 of housing 20. Using the user interface 40, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like. A media output area 38 for receiving printed media is provided in the top 30. A multipurpose input tray 88 folds out from the front of the removable media tray 100 in imaging device 10 and may be used for handling envelopes, index cards or other media where only a small number of the media will be printed. The multipurpose tray 88 may also be incorporated into front 22 of housing 20 rather than being incorporated into removable media tray 100. Hand grips 34, 74 are provided in several locations on housings 20, 65, respectively, such as on sides 24, 26, 67, 68. Also, ventilation openings, such as vents 36 are provided on imaging device 10 such as those shown on first side 24. Latches 76 are provided on each option assembly 50 to secure it to either imaging device 10 or a superior option assembly 50 in the stack.

Option assemblies 50 may be removed or added to the stack. As each option assembly 50 is added, the media path is extended. The option assemblies 50 are stackable allowing one or more option assemblies 50 to be used with a single imaging device 10. An additional option assembly 50 is typically positioned on top of the uppermost option assembly 50 in the stack. Typically, each option assembly 50 may contain a different type of media such as letterhead or a different size such as A4 or a larger quantity of the same media type that is found in the removable media tray 100 integrated into imaging device 10. Each removable media tray 100 is sized to contain a stack of media sheets that will receive color and/or monochrome images. Each removable media tray 100 may be sized to hold the same number of media sheets or may be sized to hold different quantities of media sheets. Example media sizes include but are not limited to A6, 8½"×11", A4, and 11"×17". In some instances, the removable media tray 100 in imaging device 10 may hold a lesser, equal or greater quantity of media than a removable media tray 100 found in an option assembly 50.

Figure 2:
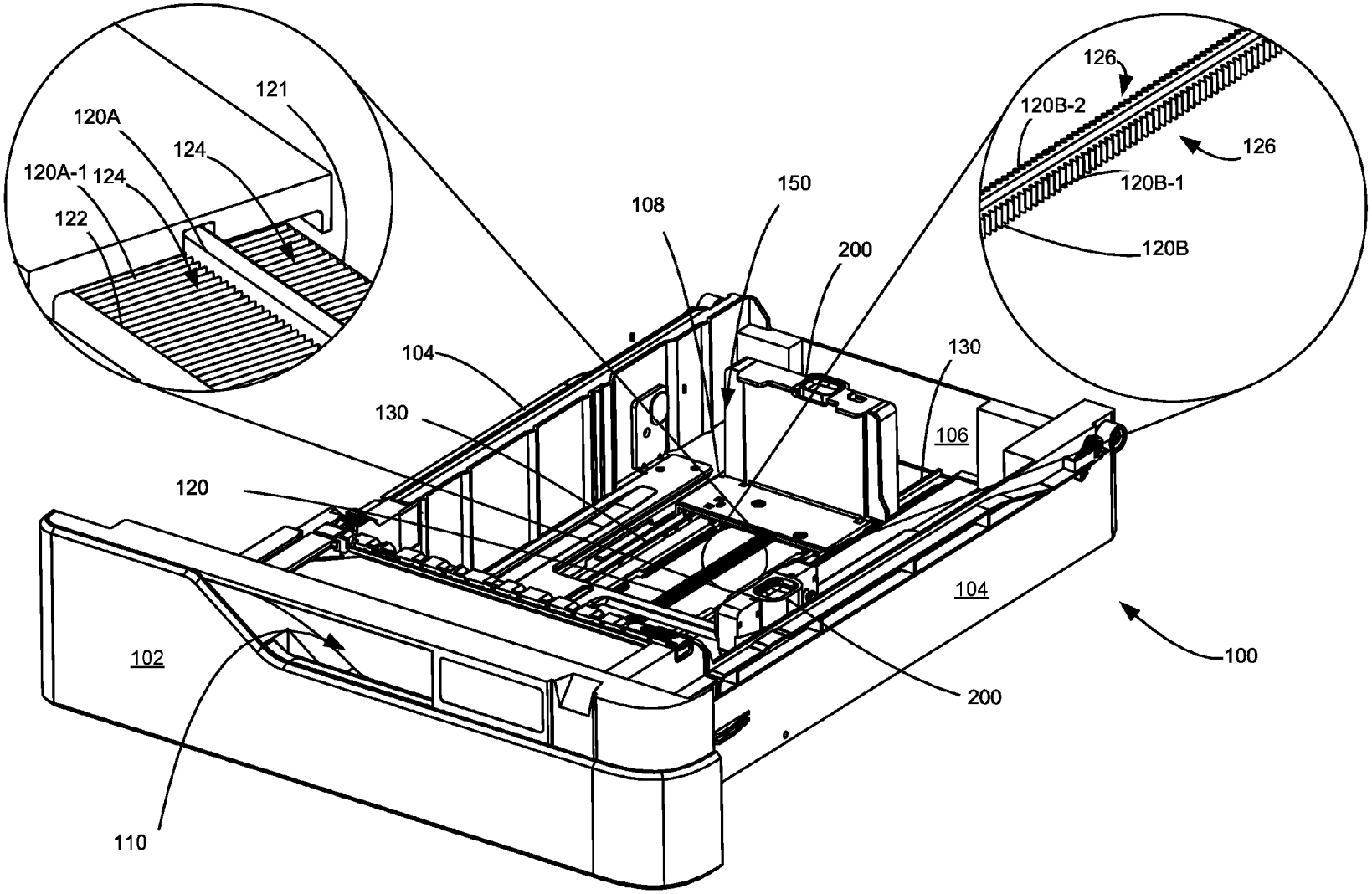
FIG. 2 is a perspective illustration of a removable media tray for the imaging device of FIG. 1 having a rear and side edge media restraint of the present disclosure and two insets showing track configurations useable with a media restraint.

Referring to FIG. 2, removable media tray 100 is shown. Removable media tray 100 is sized to hold approximately 550 pages of 20 pound media which has a media stack height of about 59 mm. Removable media tray 100 has a front wall 102, side walls 104 and a rear wall 106 depending from a bottom 108. Media storage area 150 is generally defined by front wall 102 and side walls 104, and bottom 108. Provided in each removable media tray 100 are one or more adjustable media restraints 200, shown to be placed at a rear and a side edge of the media storage area 150, to accommodate different media widths and lengths. A handle 110 is provided in front wall 102 for removing and inserting removable media tray 100 into imaging device 10 or option assembly 50.

Provided on the bottom 108 of removable media tray 100 is a track 120 on which media restraint 200 travels and latches. The insets in FIG. 2 show two configurations of the track 120. The left inset shows a track 120A having a plurality of horizontal serrations or teeth 124 across the top 120A-1 thereof. Track 120A is also illustrated as having two parallel sections 121, 122 each having a plurality of horizontal serrations 124. The right inset shows a track 120B having a plurality of vertical serrations or teeth 126 along at least one of its sides. As shown, serrations 126 are provided on each of its sides 120B-1, 120B-2. Media restraint 200 engages with the track 120 using a later described latching mechanism that engages with serrations 124 or serrations 126. One or more guide rails 130 may also be provided on the bottom 108 for guiding the media restraint 200 as it is moved between positions along track 120.

Figure 3B:
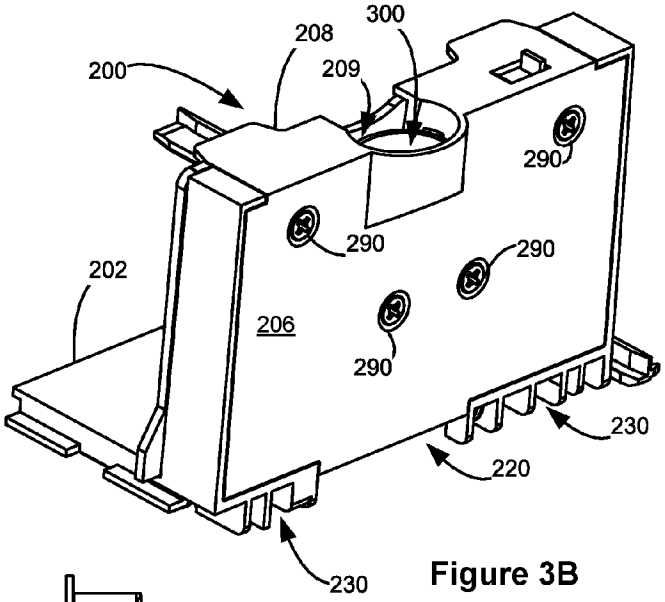
FIGS. 3A-3C are front, rear and bottom illustrations of a first embodiment of the media restraint of the present disclosure where
Figure 3A:
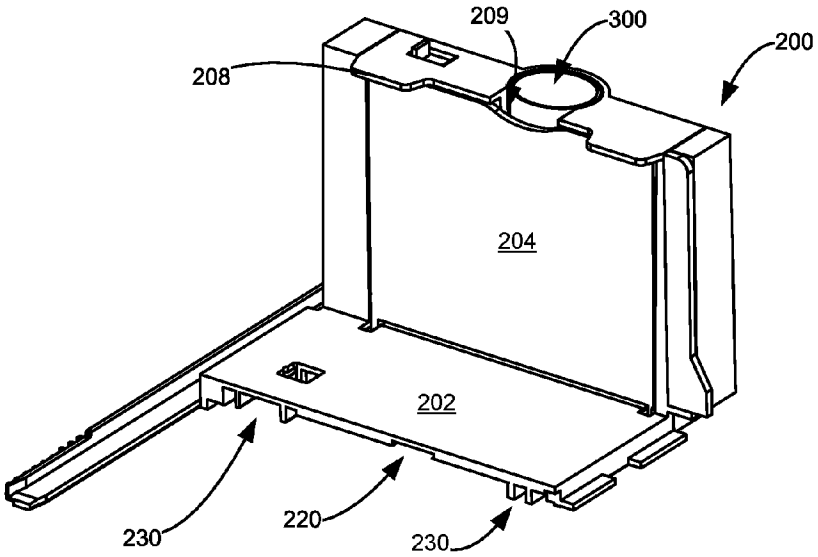
Figure 3C:
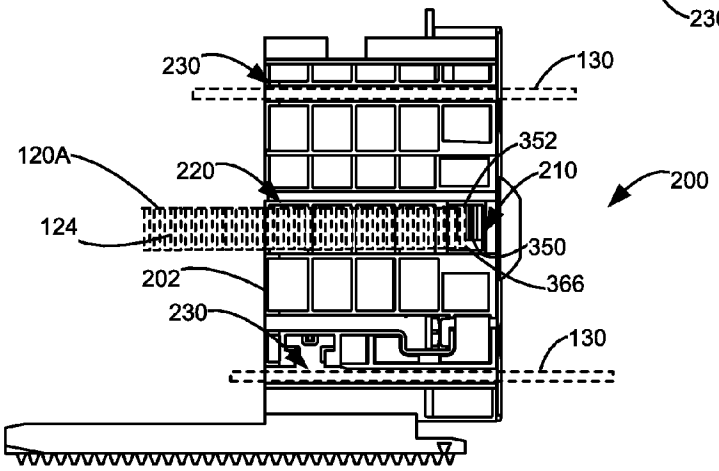

Referring to FIGS. 3A-3C, media restraint 200 has a bottom plate 202 which travels along track 120A and guide rails 130. Channels 220 and 230 are provided in the undersurface of bottom plate 202 and are sized to receive track 120A and guide rails 130, respectively. Depending from bottom plate 202 are a front plate 204 and a rear plate 206 that are joined by a top plate 208. A latching mechanism 300 is mounted between the front and rear plates 204, 206 and is used to engage the media restraint 200 to the track 120A. Latching mechanism 300 is accessible via an opening 209 in top plate 208. Latching mechanism 300 includes an actuator 310 and a plunger 350 (see FIG. 4A). Top plate 208 may be integrally molded as part of rear plate 206 or as part of front plate 204. Rear plate 206 is illustrated as being attached to front plate 202 by one or more fasteners 290. Four fasteners 290 are shown. In FIG. 3C, plunger 350 can be seen projecting through an opening 210 in bottom plate 202. A bottom 352 of plunger 350 has one or more serrations 366 used for engaging with the serrations 124 of track 120A.

Figure 4B:
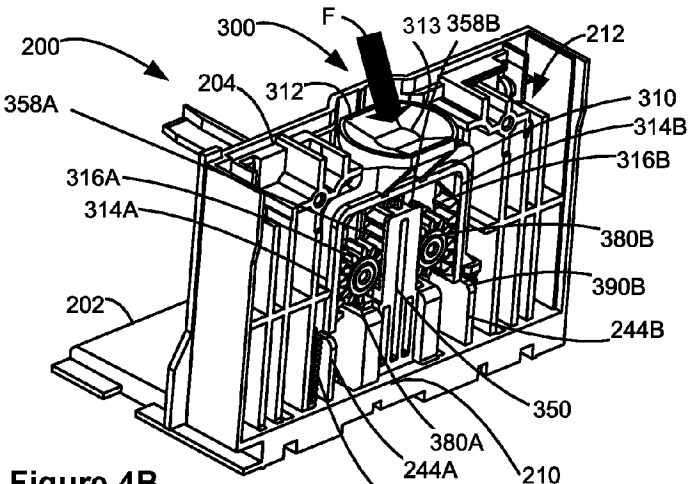
FIGS. 4A-4B are perspective rear views of the first embodiment of the media restraint with a rear plate and a top plate removed where
Figure 5B:
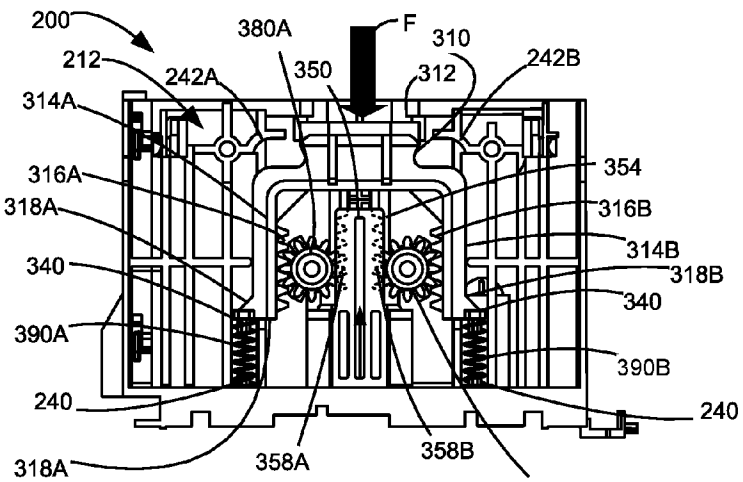
FIGS. 5A-5B are rear views of the first embodiment of the media restraint with the rear plate and the top plate removed and corresponding to FIGS. 4A-4B, respectively, where
Figure 4A:
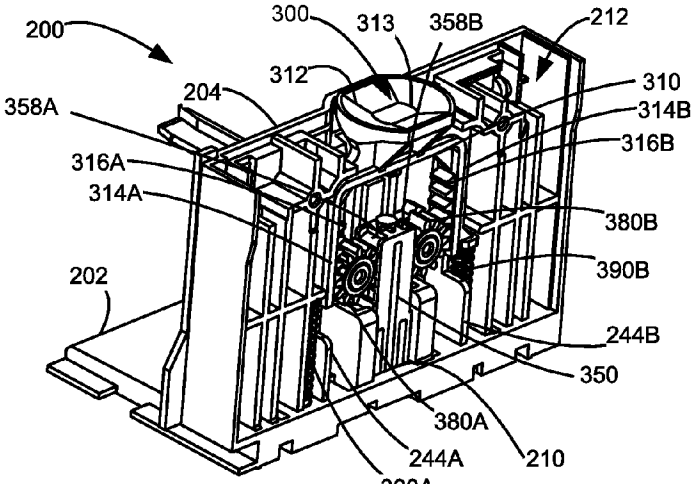

Referring to FIGS. 4A-5B, one form of latching mechanism 300 is shown. Rear and top plates 206, 208 have been removed to show latching mechanism 300. In FIGS. 4A and 5A, latching mechanism 300 is shown in an engaged position and actuator 310 and plunger 350 are shown in their respective first positions. As shown in FIG. 5A, plunger 350 is in its first position and is engaged with the serrations 124 on track 120A on the removable media tray bottom 108, the latter three indicated by the dashed line rectangles. When plunger 350 is engaged with track 120A, media restraint 200 is fixed and cannot travel along track 120A. FIGS. 4B, 5B show the latching mechanism 300 in an actuated state with actuator 310 and plunger 350 in their respective second positions allowing media restraint 200 to be moved along track 120A.

In FIGS. 4A-5B, front plate 204 is shown as having a recess 212 in which latching mechanism 300 is mounted. Latching mechanism 300 includes actuator 310, plunger 350, a first and a second pinion gear 380A, 380B and a biasing member illustrated as coil springs 390A, 390B. Actuator 310 has a button portion 312 at a top end thereof and a leg portion shown as a first and a second leg portion 314A, 314B, respectively, depending downwardly from button portion 312 toward the bottom plate 202. Button portion 312 has a concave upper surface 313 for receiving a fingertip of a user. First and second leg portions 314A, 314B each have a first and a second rack 316A, 316B along respective inside edges thereof that engage with first and second pinion gears 380A, 380B, respectively. First and second racks 316A, 316B are shown on an interior side of first and second leg portions 314A, 314B extending from a first and a second free end 318A, 318B, respectively, of first and second leg portions 314A, 314B, respectively, toward button portion 312. First and second free ends 318A, 318B may be provided with posts 340 that are aligned with posts 240 on bottom plate 202 which are used for retaining first and second coil springs 390A, 390B within the recess 212 of front plate 204.

A top portion 354 of plunger 350 is slidably positioned between first and second pinion gears 380A, 380B that are rotatably mounted to the front plate 202 and positioned approximately in the middle of front plate 202. Fasteners 290 may be used for mounting of pinion gears 380A, 380B. The bottom 352 of plunger 350 extends into opening 210 in bottom plate 202 and into track channel 220 and engages with track 120A. A first and a second rack 358A, 358B, shown in dashed lines in Figure s 5A and 5B are provided along opposite exterior sides of the top portion 354 of plunger 350 and are engaged with first and second pinion gears 380A, 380B, respectively.

Figure 5A:
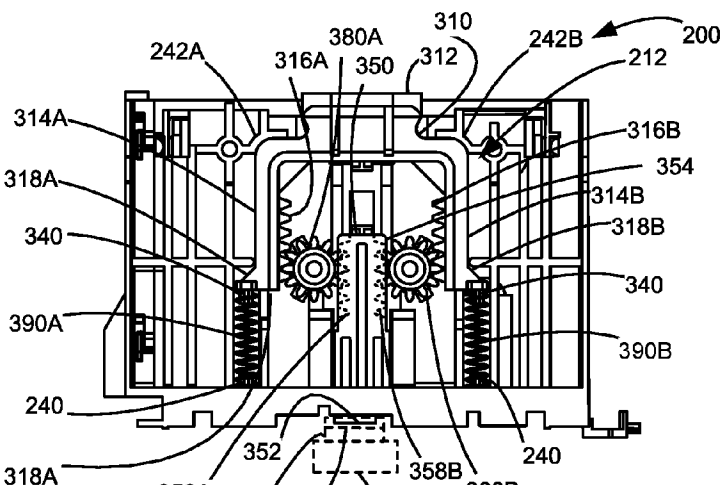
Figure 6A:
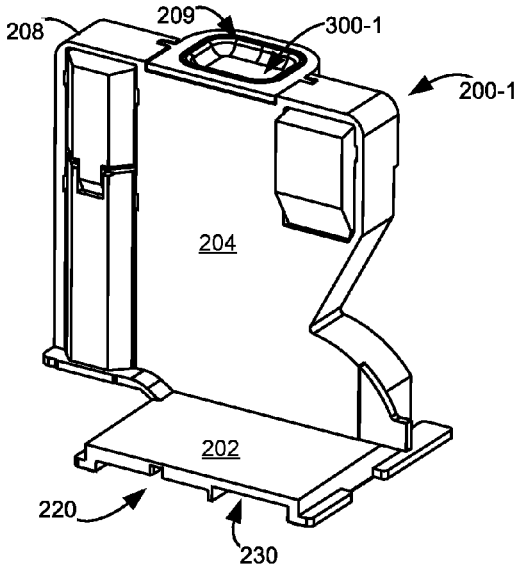
FIGS. 6A-6B are front and rear illustrations of a second embodiment of the media restraint of the present disclosure where
Figure 6B:
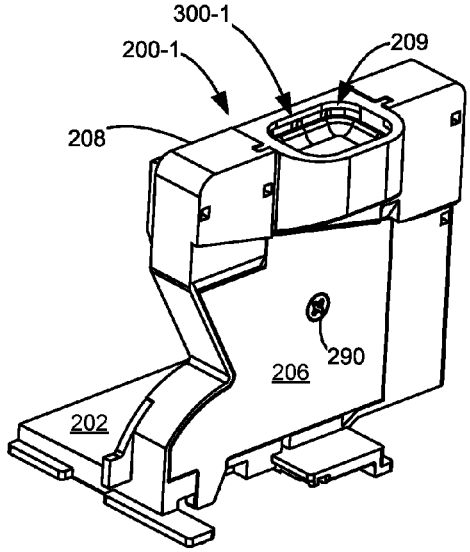

Stops may be provided to limit the downward and upward travel of actuator 310 and plunger 350. A first and a second upper stop 242A, 242B are shown depending from front plate 204 at a position above first and second leg portions 314A, 314B, respectively, to limit upward travel of actuator 310. Similarly, a first and a second lower stop 244A, 244B are shown upwardly depending from bottom plate 202 a predetermined distance and are used to limit the downward motion of actuator 310 and provide tactile feedback to the user that media restraint 200 has been disengaged from track 120B and may now be moved. As shown in FIGS. 4A, 5A, plunger 350 is in its first position is engaged with track 120A and actuator 310 is biased against upper stops 242A, 242B.

As shown in FIGS. 4B, 5B, a downwardly directed force F, indicated by the black downward arrow, from the fingertip of a user is applied to the button portion 312 of actuator 310. The actuator 310 moves from its first position and translates downwardly with the racks 316A, 316B of the leg portions 314A, 314B, respectively, rotating pinion gears 380A, 380B, raising the plunger 350, via racks 358A, 358B, from its first position and disengaging the media restraint 200 from the track 120A without the use of a pinching force. This also compresses first and second coil springs 390A, 390B. When disengaged, the media restraint 200 can be translated along the track 120A to a new location. When the downwardly directed force F is removed, the first and second coil springs 390A, 390B return the actuator 310 and plunger 350 to their respective first positions. By applying the downward force F at an angle with respect to vertical in the desired direction of movement, as shown in FIG. 4B, the user is able to move the media restraint along the track 120A with their finger without pinching the media restraint 200.

Referring to FIGS. 6A-9, a second embodiment of the present media restraint is shown. Media restraint 200-1 has a bottom plate 202 which travels along track 120A and guide rails 130. Channels 220 and 230 are provided in the bottom surface of bottom plate 202 and are sized to receive track 120A and guide rails 130, respectively (see FIG. 8A). Depending from bottom plate 202 are a front plate 204 and a rear plate 206 that are joined by a top plate 208 having an opening 209 for accessing latching mechanism 300-1. Openings 210A, 210B are provided in bottom plate 202 (see FIG. 8A) for receiving a plunger later described. A latching mechanism 300-1 is mounted between the front and rear plates 204, 206 and is used to engage the media restraint 200-1 to the track 120A. Top plate 208 may be integrally molded as part of rear plate 206 or as part of front plate 204. Rear plate 206 is attached to front plate 202 by one or more fasteners 290. A single fastener 290 is shown. Channels 220, 230 are again provided in the bottom surface of bottom plate 202.

Figure 8A:
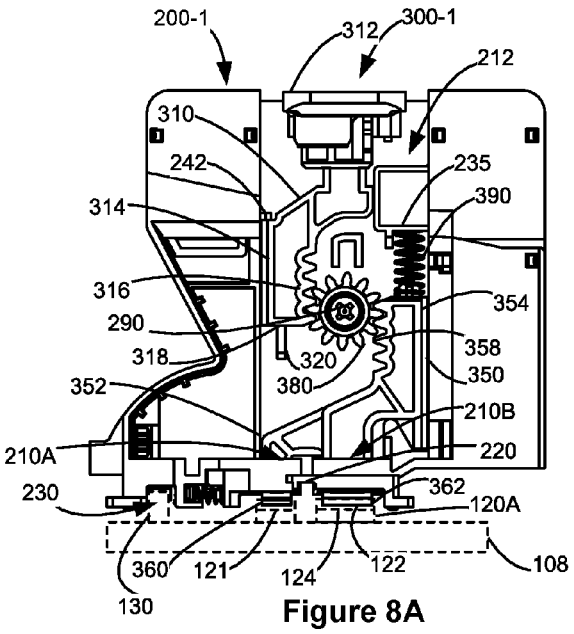
FIGS. 8A-8B are rear illustrations of the second embodiment of the media restraint of the present disclosure with the rear and top plates removed where
Figure 9:
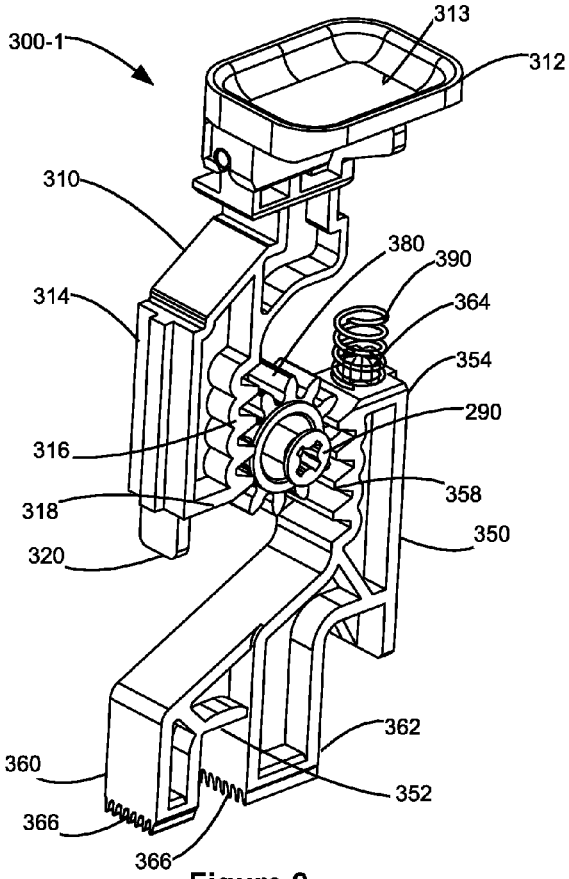
FIG. 9 is a perspective illustration of a latching mechanism used in the second embodiment of the present disclosure.

Referring to FIGS. 8A and 9, the latching mechanism 300-1 of media restraint 200-1 is shown. Latching mechanism 300-1 is comprised of an actuator 310, a plunger 350, a pinion gear 380 and a biasing member 390, illustrated as coil spring 390. Actuator 310 has a button portion 312 and a leg portion 314 depending downwardly from button portion 312 toward the bottom plate 202. Button portion 312 has a concave upper surface 313 for receiving a fingertip of a user. Leg portion 314 has a rack 316 along an inside edge thereof that engages pinion gear 380. Rack 316 is shown on an interior side of leg portion 314 extending from a free end 318 of leg portion 314 toward button portion 312. Leg portion 314 is shown vertically offset from button portion 312. A post 320 downwardly depends from free end 318 of leg portion 314. Post 320 acts as a stop to limit downward travel of actuator 310.

A top portion 354 of plunger 350 has a rack 358 engaged with pinion gear 380 that is rotatably mounted to the front plate 204. Fastener 290 may be used for this purpose. Rack 358 is shown on an interior side of top portion 354 extending toward the bottom 352 of plunger 350. Top portion 354 may be provided with a spring mount 364, shown as a cruciform post 364, onto which a bottom end of coil spring 390 is placed. A spring mount 235 depends from front plate 204 at a position above the top portion 354 of plunger 350. Coil spring 390 sits between top portion 354 of plunger 350 and a spring mount 235.

The bottom 352 of plunger 350 is divided into first and second leg portions 360, 362 each having one or more serrations 366 used for engaging horizontal serrations 124 provided in track sections 121, 122, respectively of track 120A (see left inset of FIG. 2). First and second leg portions 360, 362 of the bottom 352 extend through openings 210A, 210B (see FIG. 8A) provided in bottom plate 202 and then into track channel 220 for engaging with track 120A. Channel 230 for guide rail 130 is also shown. The bottom 352 of plunger 350 is vertically offset from top portion 354. The vertical offsets provided in actuator 310 and plunger 350 relative to each other provide for a more compact design for latching mechanism 300-1.

Figure 7A:
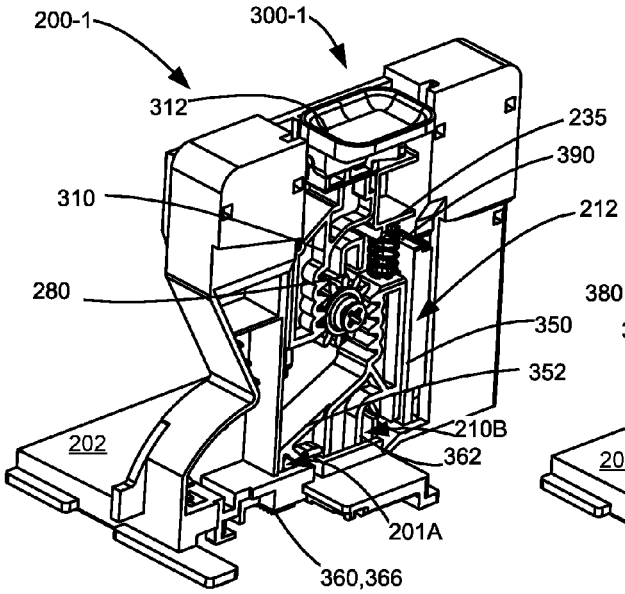
FIGS. 7A-7B are perspective rear illustrations of the second embodiment of the media restraint of the present disclosure with the rear and top plates removed where

Referring to FIGS. 7A-8B, latching mechanism 300-1 is shown. Rear and top plates 206, 208 have been removed to show latching mechanism 300-1. Front plate 204 is shown as having recess 212 in which latching mechanism 300-1 is mounted. In FIGS. 7A and 8A, latching mechanism 300-1 is shown to be biased by coil spring 390 into an engaged position and actuator 310 and plunger 350 are in their respective first positions. As shown in FIG. 8A, plunger 350 is in its first position engaged with track 120A and actuator 310 is biased against upper stop 242 that depends from front plate 204. Track 120A with horizontal serrations 124 on the removable media tray bottom 108 and guide rail 130 are shown in dashed line. In FIG. 8A, a bottom 352 of a plunger 350 can be seen projecting through openings 210A, 210B in bottom plate 202. When plunger 350 is engaged with track 120A, media restraint 200-1 is fixed and cannot travel along track 120A.

Figure 7B:
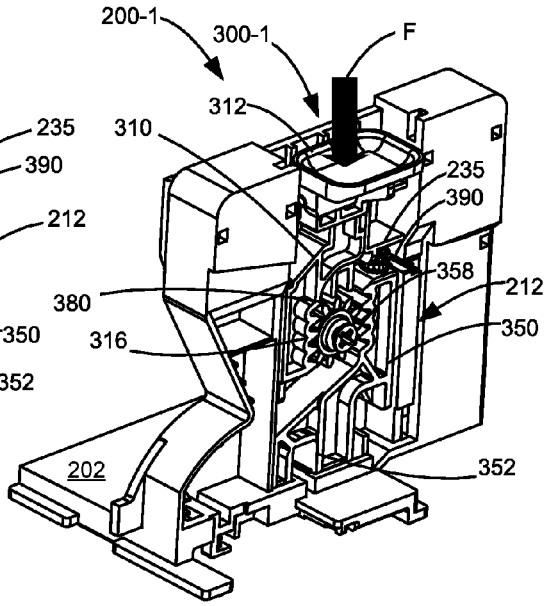
Figure 8B:
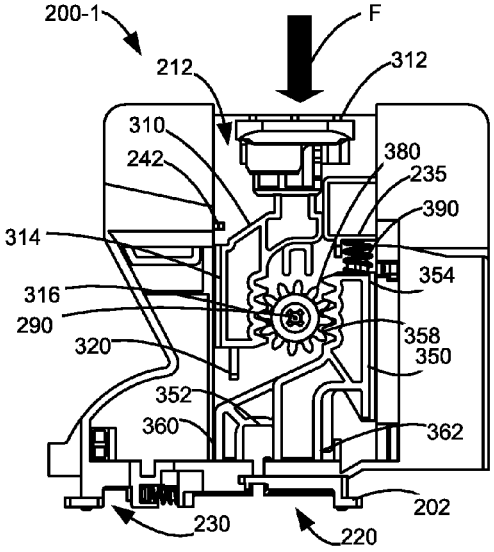

FIGS. 7B and 8B show the latching mechanism 300-1 actuated by a user-supplied downward force F, indicated by the black arrow, that is applied to the button portion 312 of actuator 310. Actuator 310 is translated downwardly to its second position with rack 316 rotating pinion gear 380 using rack 358 to lift plunger 350 into its respective second position and compressing coil spring 390 against spring mount 235. When actuator 310 and plunger 350 are in their respective second positions, media restraint 200-1 is disengaged from track 120A and can be moved along track 120A. With continued downward pushing by the user on actuator 310, post 320 will contact plunger 350 stopping further downward and upward movement of actuator 310 and plunger 350, respectively, and providing tactile feedback to the user that media restraint 200-1 has been disengaged from track 120A. By applying the downward force F at an angle with respect to vertical in the desired direction of movement as previously noted, the user is able to move the media restraint 200-1 along the track 120A with their finger without the use of pinching.

Figure 10:
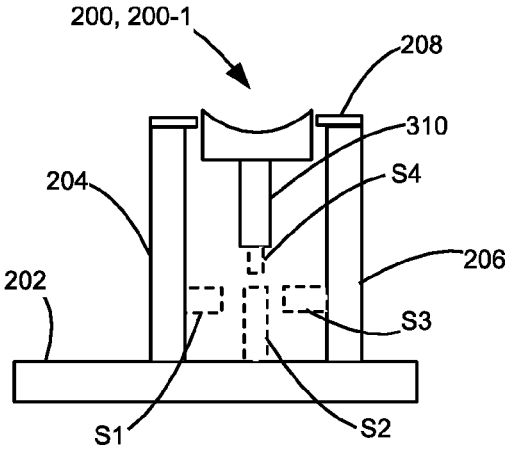
FIG. 10 is a schematic illustration of various mounting locations for stops used in the media restraints of the present disclosure.
Figure 11:
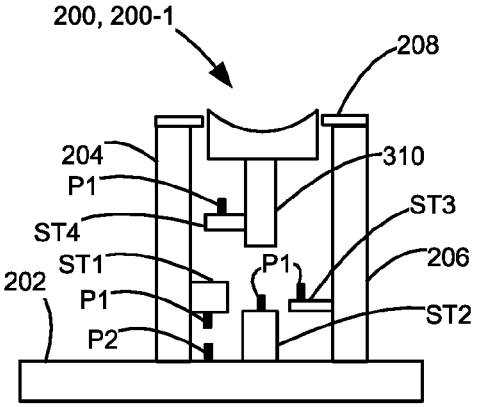
FIG. 11 is a schematic illustration of various mounting locations for spring seats used in the media restraints of the present disclosure.
Figure 12:
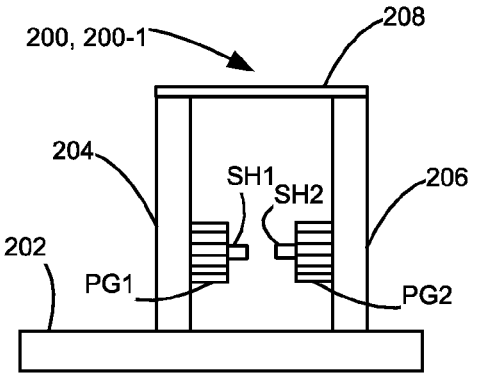
FIG. 12 is a schematic illustration of various mounting locations for pinion gears used in the media restraints of the present disclosure.

Referring now to FIGS. 10-12, various mounting arrangements for stops, spring seats and the pinion gears are schematically illustrated. In FIG. 10, stops S1, S2, S3 are shown mounted on the front plate 204, bottom plate 202, and rear plate 206, respectively. Stop S4 is shown depending from the bottom of actuator 310. Spring seats ST1-ST4 are used for seating biasing members, such as springs 390, 390A, 390B in media restraints 200, 200-1. In FIG. 11, spring seats ST1, ST2, ST3 are shown mounted on the front plate 204, bottom plate 202, and rear plate 206, respectively. Spring seat ST4 is shown depending from the actuator 310. Post P1 may be provided on seats ST1-ST4. Post P2 is shown depending from bottom plate 202. Posts P1, P2 may be used to hold biasing members on their respective spring seats. In FIG. 12, pinion gears PG1, PG2 are shown mounted on shafts SH1, SH2 on the front and rear plates 204, 206, respectively. The number and location of the stops, spring seats, posts, and shafts are a matter of design choice and the locations shown in the figures are for the purpose of illustration and not limitation and similarly for the number and mounting of the pinion gears and the number and mounting of the biasing members.

For the disclosed embodiments of the media restraint, front plate 204 is shown to have the recess into which the latching mechanisms are mounted. As would be understood by one of ordinary skill in the art, the latching mechanisms may be mounted to the rear plate or some components may be mounted to the front plate and others to the rear plate. The mounting arrangement for the latching mechanism is a matter of design choice and the configurations shown should not be taken as limiting. For media restraints 200, 200-1, the mounting of bottom plate 202, front plate 204, rear plate 206, and top plate 208 to one another is a matter of design choice, and the configurations shown should not be viewed as limiting.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A removable media tray for an imaging device, the removable media tray comprising:

a bottom surface for holding media to be fed to the imaging device;

a track having a plurality of teeth along a length thereof, the track positioned on the bottom surface; and, a media restraint slidably engageable with the track, the media restraint including:

a bottom plate having a first opening therethrough;

a front plate depending from the bottom plate;

a rear plate spaced from and attached to the front plate; and, a latching mechanism positioned between the front and rear plates, the latching mechanism including:

a pinion gear rotatably attached to one of the front and rear plates between a top and a bottom thereof;

an actuator slidably received between the front and rear plates and having a first position where an upper end thereof is adjacent a top of the front and the rear plates, the actuator having a button portion at the upper end thereof and a leg portion depending from the button portion and extending toward the bottom plate, the leg portion having a rack engaged with the pinion gear;

a plunger slidably positioned between the front and rear plates, the plunger having a serrated bottom end slidably received in the first opening and a rack engaged with the pinion gear, the plunger having a corresponding first position wherein the bottom end is engaged with the track when the actuator is in its first position; and, a biasing member for biasing the actuator and the plunger into their respective first positions, wherein, upon application of a user-supplied downwardly directed force to the button portion, the actuator moves from its first position and translates downwardly with the rack of the leg portion rotating the pinion gear raising the plunger from its first position allowing the media restraint to be translated along the track to a new location, and, further wherein, when the downwardly directed force is removed, the biasing member returns the actuator and plunger to their respective first positions.

2. The removable media tray of claim 1, wherein the biasing member is mounted between the bottom plate and a bottom of the leg portion for biasing the actuator and the plunger into their respective first positions.

3. The removable media tray of claim 1, wherein the biasing member is mounted between a top of the plunger and a mount depending from one of the front and rear plates for biasing the actuator and the plunger into their respective first positions.

4. The removable media tray of claim 1, wherein the track further comprises a pair of parallel tracks and the bottom of the plunger has a first bottom portion engaged with one track of the pair of parallel tracks and a second bottom portion engaged with the other track of the pair of parallel tracks when the plunger is in its first position.

5. The removable media tray of claim 1, wherein the pinion gear comprises a first and second pinion gear, the leg portion comprises a first and second leg each having a rack portion engaged with each of the first and second pinion gears, respectively, the plunger has a first and a second rack portion engaged with the first and second pinion gears, respectively, and the biasing member comprises a first and a second spring mounted between the bottom plate and a bottom end of the first leg and the second leg, respectively.

6. The removable media tray of claim 1, wherein a stop depends from one of the bottom plate, front plate and rear plate, the actuator contacting the stop during its downward translation to limit the downward translation thereof.

7. The removable media tray of claim 1, wherein the button portion has a concave surface for receiving and holding a fingertip of a user.

8. The removable media tray of claim 1, wherein the bottom plate has a channel therein aligned with and sized to receive a second track that is parallel to the track of the removable media tray.

9. A removable media tray for an imaging device, the removable media tray comprising:

a bottom surface for holding media to be fed to the imaging device;

a track having a plurality of teeth along a length of the track, the track positioned on the bottom surface; and, a media restraint slidably engageable with the track, the media restraint including:

a bottom plate having a first opening therethrough;

a front plate depending from the bottom plate, the front plate having a recess therein sized to receive a latching mechanism, the recess having a bottom open to the first opening in the bottom plate and a top opening;

a rear plate for substantially enclosing the recess;

one or more fasteners for attaching the rear plate to the front plate;

and, the latching mechanism including:

a pinion gear rotatably attached to one of the front and rear plates between the top and the bottom thereof;

an actuator slidably received in the recess and having a first position adjacent to a top of the front plate, the actuator having a button portion and a leg portion, the button portion at an upper end of the actuator having a concave upper surface aligned with and accessible through the top opening of the recess, and the leg portion depending from the button portion and extending toward the bottom plate and having a rack engaged with the pinion gear;

a plunger slidably positioned in the recess, the plunger having a serrated bottom end slidably received in the first opening of the bottom plate and a rack engaged with the pinion gear, the plunger having a corresponding first position wherein the bottom end is engaged with the track when the actuator is in its first position; and, a biasing member for biasing the actuator and the plunger into their respective first positions, wherein, upon application of a user-supplied downwardly directed force to the button portion, the actuator moves from its first position and translates downwardly with the rack of the leg portion thereby rotating the pinion gear and raising the plunger from its first position allowing the media restraint to be translated along the track to a new location, and, further wherein, when the downwardly directed force is removed, the biasing member returns the actuator and plunger to their respective first positions.

10. The removable media tray of claim 9, wherein the biasing member is mounted between the bottom plate and a bottom of the leg for biasing the actuator and the plunger into their respective first positions.

11. The removable media tray of claim 9, wherein the biasing member is mounted between a top of the plunger and a mount depending from the front for biasing the actuator and the plunger into their respective first positions.

12. The removable media tray of claim 9, wherein the track further comprises a pair of parallel tracks and the bottom end of the plunger has a first bottom portion engaged with one track of the pair of parallel tracks and a second bottom portion engaged with the other track of the pair of parallel tracks when the plunger is in its first position.

13. The removable media tray of claim 9, wherein the pinion gear comprises a first and second pinion gear, the leg portion comprises a first and second leg each having rack portions engaged with the first and second pinion gears, respectively, the plunger has a first and a second rack portion engaged with the first and second pinion gears, respectively, and the biasing member comprises a first and a second spring mounted between the bottom plate and a bottom end of the first leg and the second leg, respectively.

14. A media restraint for a removable media tray for an imaging device, the media restraint comprising:

a bottom plate having a first opening therethrough;

a front plate and a rear plate spaced from and attached to the front plate, the front plate depending from the bottom plate;

a top plate extending between the front and rear plate having a second opening therethrough; and, a latching mechanism positioned between the front, rear and top plates, the latching mechanism including:

a pinion gear rotatably attached to one of the front and rear plates between a top and a bottom thereof;

an actuator slidably received between the front and rear plates and having a first position adjacent the top plate, the actuator having a button portion at an upper end thereof and positioned adjacent to the top plate and aligned with the second opening and a leg portion offset and depending from the button portion and extending toward the bottom plate, the leg portion having a rack engaged with the pinion gear;

a plunger slidably positioned between the front and rear plates, the plunger having a serrated bottom end slidably received in the first opening, a rack offset from the bottom end and engaged with the pinion gear and a first spring mount on an upper end of the plunger, the bottom end of the plunger having a first and a second serrated portion engageable with a first and a second serrated track, respectively, in the removable media tray, the plunger having a corresponding first position wherein the bottom end is engageable with the first and seconds tracks in the removable media tray when the actuator is in its first position;

a second spring mount depending from one the front and rear plates positioned above the first spring mount; and, a spring for biasing the actuator and the plunger into their respective first positions, the spring mounted between the first and second spring mounts, wherein, when the media restraint is installed in the removable media tray, upon application of a user-supplied downwardly directed force to the button portion, the actuator moves from its first position wherein the bottom end of the plunger is engaged with the first and second tracks and translates downwardly with the rack of the leg portion thereby rotating the pinion gear and raising the plunger from its first position allowing the media restraint to be translated along the first and second tracks to a new location, and, further wherein, when the downwardly directed force is removed, the spring returns the actuator and plunger to their respective first positions.

15. The media restraint of claim 14, wherein a stop depends from a bottom of the leg portion of the actuator, the stop contacting the plunger to limit downward motion of the actuator.

16. The media restraint of claim 14, wherein the button portion has a concave surface for receiving and holding a fingertip of a user.

17. The media restraint of claim 14 wherein the bottom plate has a channel therein aligned with and sized to receive the first and second tracks of the removable media tray.

18. A media restraint slidably mountable on a first track in a removable media tray for an imaging device, the media restraint comprising:

a bottom plate having a first opening therethrough;

a front plate and a rear plate spaced apart from the front plate, the front and rear plates depending from the bottom plate;

a top plate extending between the front and rear plates having a second opening therethrough; and, a latching mechanism positioned between the front, rear, and top plates, the latching mechanism including:

a first and a second pinion gear, the first and second pinion gears rotatably attached to one of the front and rear plates between a top and a bottom thereof;

an actuator slidably received between the front and rear plates and having a first position adjacent the top plate, the actuator having a button portion at an upper end thereof positioned adjacent to the top plate and aligned with the second opening, the actuator further having a first and a second leg portion each depending from the button portion and extending toward the bottom plate, the first and second leg portions each having a rack engaged with the first and second pinion gears, respectively, and, a first and a second spring mount provided on a bottom end of the first and the second leg portions, respectively;

a plunger slidably positioned between the front and rear plates and the first and the second pinion gears, the plunger having a serrated bottom end slidably received in the first opening, the plunger further having a first and a second rack engaged with the first and second pinion gears, respectively, the plunger having a corresponding first position wherein the bottom end thereof is engageable with the first track in the removable media tray when the actuator is in its first position; and, a first spring and a second spring for biasing the actuator and the plunger into their respective first positions, the first and second springs mounted between the bottom plate and the first and second spring mounts, respectively, wherein, when the media restraint is installed in the removable media tray, upon application of a user-supplied downwardly directed force to the button portion, the actuator moves from its first position wherein the bottom of the plunger is engaged with the first track and translates downwardly with the racks of the first and second legs rotating the first and second pinion gears, respectively, raising the plunger from its first position allowing the media restraint to be translated along the first track to a new location, and, further wherein, when the downwardly directed force is removed, the first and second springs return the actuator and plunger to their respective first positions.

19. The media restraint of claim 18, wherein a stop depends from the bottom plate, one of the first and second leg portions contacting the stop during downward translation of the actuator to limit the downward translation thereof.

20. The media restraint of claim 18, wherein the button portion has a concave surface for receiving and holding a fingertip of a user.

* * * * *